US006264388B1

(12) United States Patent
Wang

(10) Patent No.: US 6,264,388 B1
(45) Date of Patent: Jul. 24, 2001

(54) ROTARY LOCATOR WITH DIFFERENTIAL POSITION IN A PEN

(75) Inventor: Thomas Wang, Taipei (TW)

(73) Assignee: Excel Rite Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 09/742,065

(22) Filed: Dec. 22, 2000

(51) Int. Cl.[7] ..... B43K 24/02; B43K 5/16; B43K 7/12

(52) U.S. Cl. ..... 401/109; 401/99; 401/110; 401/111

(58) Field of Search ..... 401/99, 109–112

(56) References Cited

U.S. PATENT DOCUMENTS 2,741,226 * 4/1956 Dietrich et al. ..... 401/109
2,896,577 * 7/1959 Merryman et al. ..... 401/109

FOREIGN PATENT DOCUMENTS

508090 * 1/1955 (IT) ..... 401/109

* cited by examiner

*Primary Examiner*—Gregory L. Huson
*Assistant Examiner*—Tuan Nguyen
(74) *Attorney, Agent, or Firm*—Dougherty & Troxell

(57) ABSTRACT

A rotary locator with differential position in a pen comprises an adapter head, a follower stem, and a cam. The adapter head is fixed at the top of the pen, an upper forked portion with a pivot device at the top thereof to form a groove seat, and a lower portion thereof has a central through hole. The follower stem is disposed in the central through hole and extends inward the pen. The cam is disposed in the groove seat, has two opposite flat planes on the contour thereof, an eccentric device between said two flat planes, and the eccentric device to align with the pivot device so as to rotate in the groove seat eccentrically. While the cam is turned, the follower stem displaces by way of a top thereof keeping contact with the contour of the cam. The follower stem can be located at one of two specific positions respectively because of the pivot device having different distances apart said two opposite flat planes respectively. Thus, the center stick under the follower stem may be displaced such that a spring therein can be compressed or stretches to allow a nib part of the pen extending outward from or moving backward into the pen.

6 Claims, 2 Drawing Sheets

ROTARY LOCATOR WITH DIFFERENTIAL POSITION IN A PEN

BACKGROUND OF THE INVENTION

1. Field of The Invention

The present invention relates to a rotary locator with differential position in a pen. In particular, the present invention relates to a rotary locator with differential position in a pen, in which an eccentric cam is actuated to perform a relative movement of a follower stem and a differential position so as to displace and locate the center stick in the pen.

2. Description of Related Art

A pen is used for writing and sketching since very early years. According to the industry and business progress and technology development, the pen has presented multiple aspects already. General speaking, the pen can be classified into three categories based on the structure and the operation way. One of these three categories is the nib part of the center stick in the pen is enclosed by a pen cap. Another one is the center stick can be extended outward and retreated inward by way of turning the penholder. The last one is the center stick can be extended outward and be retreated inward by way of push device.

The types of pen with turned penholder and with push device are much popular and have been keeping be used till now. Because the nib part of the center stick can be received in the pen automatically for these two types of pen, no need of the pen cap to cover the nib part for clipping to clothes and preventing from staining the clothes.

For the push type of pen, it can be divided into that with bounce device and with lock device respectively. The bounce device comprises a press cap and a bounce key under the press cap. The bounce key is moved downward synchronously to result in the rotary key thereof pressing against a rib part at the top thereof. Thus, a differential position is formed to squeeze the center stick and a spring in the penholder so as to expose the nib part of the center stick for writing. The lock device comprises a press stem with a lateral elastic tenon. The elastic tenon can move away the first locking recess and engages with the second locking tenon to form a differential position as soon as the press stem is pushed downward. Then, the center stick and the spring in the penholder are squeezed to expose the nib part for writing.

The preceding two push types of pens cause the center stick in the penholder to move outward and inward mainly by way of the push device constituting a differential position and a locating relation. Therefore, it can be entitled "push type of locator with differential position". Accordingly, how to breakthrough the conventional locator with differential position is a subject worth the supplier to consider.

SUMMARY OF THE INVENTION

An object of the present invention is to provide a rotary locator with differential position in a pen, which has a structure to move the nib part of the center stick automatically simply by way of rotating an eccentric cam with two opposite flat planes.

BRIEF DESCRIPTION OF THE DRAWINGS

The present invention can be more fully understood by referring to the following description and accompanying drawings, in which.

DETAILED DESCRIPTION OF THE PREFERRED EMBODIMENTS

Figure 1:
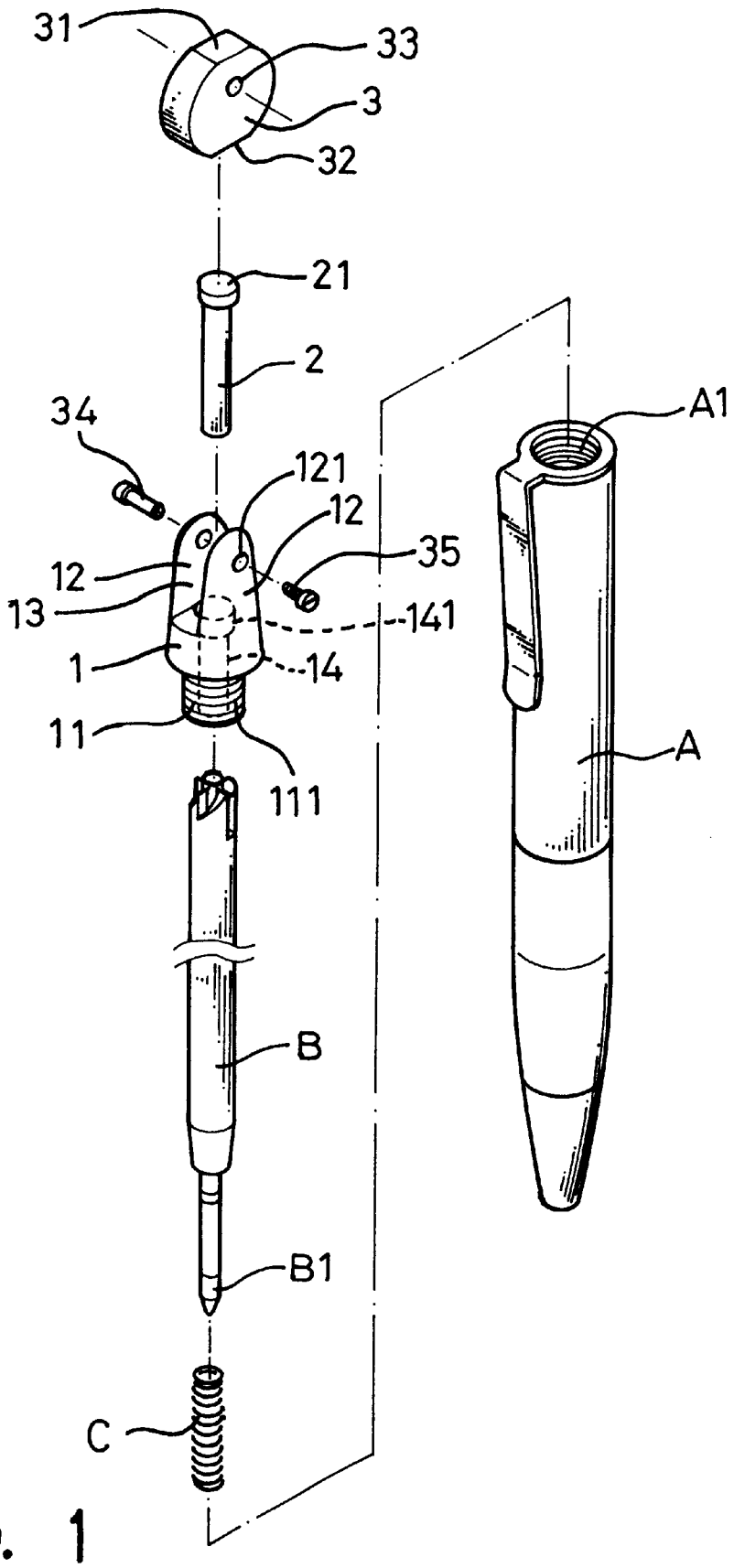
FIG. 1 is an exploded perspective view of a rotary locator with differential position in a pen according to the present invention.
Figure 3:
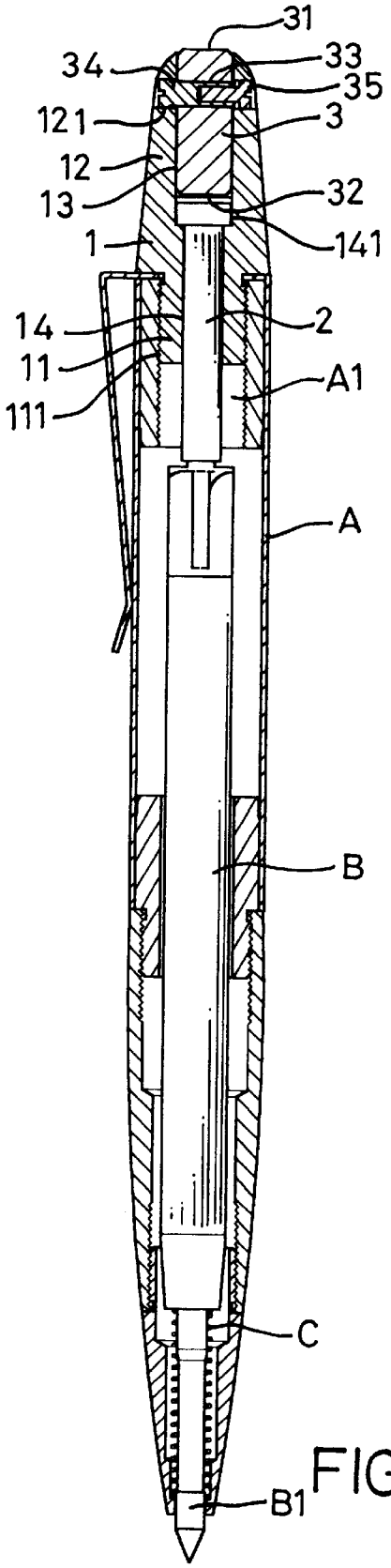
FIG. 3 is a sectional view illustrating the rotary wheel shown in FIG. 2 having been rotated to a locking position.
Figure 2:
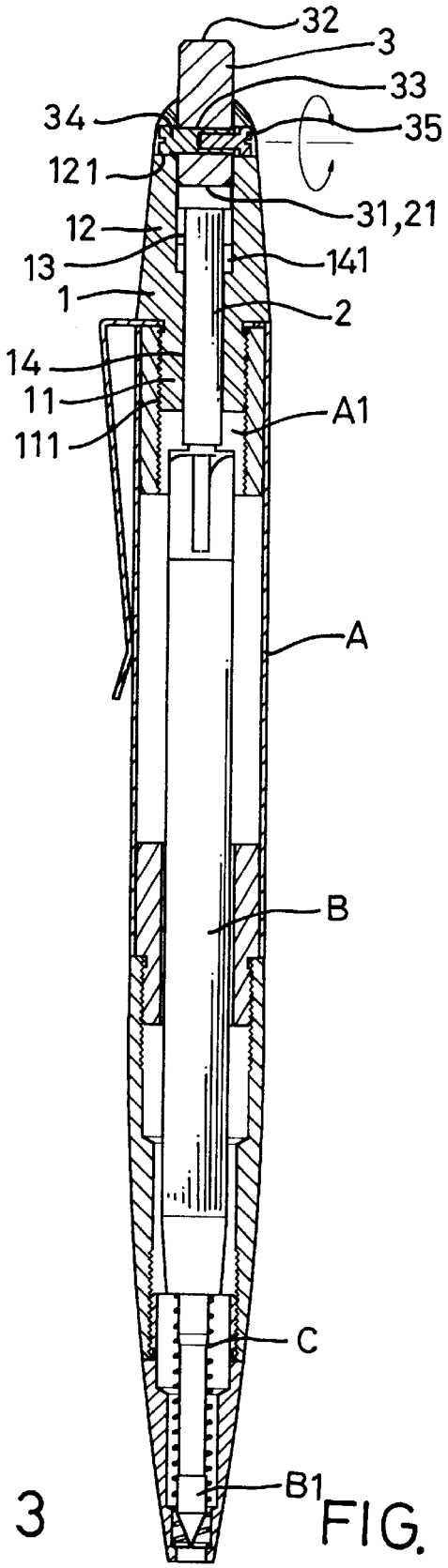
FIG. 2 is an assembled sectional view of the rotary locator with differential position in a pen shown in FIG. 1 illustrating a rotary wheel in a state of having not been operated yet.

Referring to FIGS. 1 to 3, a rotary locator with differential position in a pen according to the present invention basically comprises a adapter head 1, a follower stem 2, and a cam 3.

The adapter head 1 is a U-shaped body, which is disposed at the top of a pen "A". As shown in these figures, the adapter head 1 at the lower connecting portion 11 thereof can be a threaded part 111 to engage with an upper opening "A1" or can be other engaging ways such as press fit or adhesive to attach to the upper opening "A1". Besides, the upper forked portion 12 of adapter head 1 forms a groove seat 13. Furthermore, a pivot device 121 such as a pivot hole is provided at the upper part of the forked portion 12 and lower portion of the adapter head 1 is provided with a central through hole 14.

The follower stem 2 has a length longer than the through hole 14 so as to pass through the through hole 14 from the opening end A1 for connecting with the center stick "B". Besides, the follower stem 2 may provides a stem head 21 with a diameter greater than that of the stem 2 itself such that the stem head 2 can be received in a counter bore 141 provided on the through hole 14. In this way, it is possible for the follower stem 2 to avoid falling into the through hole 14 in case of being not supported by the center stick "B" and to keep the orientation thereof during assembling and have a better contact relation with the cam 3.

The cam 3 is disposed in the groove seat 13 and has two opposite flat planes 31, 32 on the outer rim thereof and an eccentric device 33 such as an eccentric hole between flat planes 31, 32. The eccentric device 33 is aligned with the pivot device 121 as soon as the cam 3 is placed in the groove seat 13 and the cam 3 can rotate eccentrically with respect to the pivot device 121 as a fulcrum.

Furthermore, the preceding pivot device 121 is arranged as a pivot hole and the eccentric device 33 is arranged as an eccentric hole to align with each other. Then, a pivot 34 is inserted through the aligned pivot hole and the eccentric hole and fastened by a bolt 35 to constitute a state of pivotal connection. Alternatively, a rivet pin can be used for connecting the cam 3 and the adapter head 1 instead of the sleeve 35 fastened by the bolt 35. Also, the adapter head 1 and the cam 3 can be integrally made of high molecular material by way of injection mold to provide a proper elasticity. Therefore, the pivot device 121 is formed of a post/axial hole opposite to each other and the eccentric device 33 is formed of an axial/post opposite to each other. These two alternatives can reach the effect of preceding pivot connection and are the scope of protection of the present invention.

Referring to FIGS. 2 and 3, the cam 3 is rotated first and the stem head 21 is displaced along the contour of the cam 3as shown in FIG. 3. When the flat plane 32 (it is farther away the pivot device 33) urges against the stem head 21, the stem head 21 is moved into the counter bore 141 to have the center stick "B" move downward and press the spring "C". Thus, the nib part "B" can extend outward from the lower end of pen "A" for writing. When the pen is not in use and the cam 3 is rotated again, another flat plane 31 (it is near the pivot device 33) may urges against the stem head 21. The spring "C", stretches because of a reduced distance between flat plane 31 and the pivot device 33 to result in the center stick "B" moves upward with the follower stem 2. Thus, the nib part "B1" may move backward in the pen "A".

It can be understood from the preceding description of preferred embodiment that the center stick in a pen can be displaced by way of rotary locating device in addition to the push and bounce device, the push and lock device, and the way of rotated penholder. When the locating device with differential position of the present invention is in operation, it is only necessary to turn an eccentric cam with two opposite flat planes so as to expose or retreat the nib part of the pen. It is appreciated that a pivot device is provided between said two opposite flat planes with different distances to have the follower stem being located at two stage position. Thus, the center stick under the follower stem may be displaced accordingly such that the spring therein can be compressed or stretches to allow the nib part extending outward from or moving backward into the pen easily and simply. Therefore, the locating device with differential position disclosed in the present invention is novel and has never seen in the prior art.

While the invention has been described with reference to preferred embodiment thereof, it is to be understood that modifications or variations may be easily made without departing from the spirit of this invention, which is defined by the appended claims.

What is claimed is:

1. A rotary locator with differential position in a pen, comprising an adapter head, being fixed at a top of the pen, having an upper forked portion with a pivot device at a top thereof to form a groove seat, and having a lower portion with a central through hole;

a follower stem having a stem head portion and a stem portion, being disposed in the central through hole and extending into the pen, wherein the stem head portion has a circumference size greater than the stem portion for preventing said follower stem from going through said adapter head and into the pen; and a cam, being disposed in the groove seat, having two opposite flat planes on a contour thereof, having an eccentric device between said two flat planes, and having the eccentric device to align with the pivot device so as to rotate in the groove seat eccentrically;

whereby, while the eccentric cam is turned, the follower stem displaces by way of a top thereof keeping contact with the contour of the cam; the follower stem can be located at one of two specific positions respectively because of the pivot device having different distances apart said two opposite flat planes respectively; and a center ink stick under the follower stem may be displaced such that a spring therein can be compressed or stretches to allow a nib part of the ink stick extending outward from or moving backward into the pen.

2. The rotary locator with differential position in a pen according to claim 1, wherein the lower portion has a connecting part engaging with an opening end of the top of said adapter head by way of threaded connection, press fit, or adhesive.

3. The rotary locator with differential position in a pen according to claim 1, wherein the pivot device and the eccentric device are a pivot axial hole and an eccentric axial hole respectively aligning with each other so as to be passed through a sleeve and fastened by a bolt.

4. The rotary locator with differential position in a pen according to claim 1, wherein the pivot device and the eccentric device are a pivot axial hole and an eccentric axial hole respectively aligning with each other so as to be passed through and fastened by a rivet pin.

5. The rotary locator with differential position in a pen according to claim 1, wherein the pivot device and the eccentric device are a pair of posts/axial holes and a pair of eccentric holes/ posts respectively fitting with in a way of posts engaging with axial holes one another.

6. The rotary locator with differential position in a pen according to claim 5, wherein the pivot device and the eccentric device are made of high molecular by way of injection mold.

* * * * *